US007213570B2

(12) United States Patent
Zhang

(10) Patent No.: US 7,213,570 B2
(45) Date of Patent: May 8, 2007

(54) METHOD AND APPARATUS FOR CONTROLLING THROTTLE DURING VEHICLE COASTING

(75) Inventor: Rong Zhang, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/215,150

(22) Filed: Aug. 30, 2005

(65) Prior Publication Data

US 2007/0044758 A1 Mar. 1, 2007

(51) Int. Cl.
*F02D 11/10* (2006.01)
*F02D 9/00* (2006.01)

(52) U.S. Cl. ..... 123/399; 123/436; 123/349

(58) Field of Classification Search ..... 123/399, 123/436, 349, 376; 73/118.1, 118.2; 701/103, 701/110

See application file for complete search history.

(56) References Cited

U.S. PATENT DOCUMENTS

| | | | | |
|---|---|---|---|---|
| 4,938,308 | A | 7/1990 | Takayama | |
| 5,443,148 | A | 8/1995 | Shi | |
| 5,517,411 | A * | 5/1996 | Genise et al. | 701/53 |
| 5,868,214 | A * | 2/1999 | Workman | 180/179 |
| 5,944,766 | A * | 8/1999 | White | 701/94 |
| 6,076,036 | A * | 6/2000 | Price et al. | 701/93 |
| 6,374,173 | B1 * | 4/2002 | Ehlbeck | 701/93 |
| 6,470,256 | B1 * | 10/2002 | Cikalo et al. | 701/93 |
| 6,474,297 | B1 | 11/2002 | De | |
| 2004/0102288 | A1 * | 5/2004 | Ayabe et al. | 477/117 |

FOREIGN PATENT DOCUMENTS

| | | | |
|---|---|---|---|
| EP | 0600163 | A2 | 6/1994 |
| EP | 0600163 | A3 | 11/1994 |
| GB | 2279123 | | 12/1994 |
| JP | 52101529 | A | 8/1977 |
| JP | 02014922 | A | 1/1990 |
| JP | 07071493 | A | 3/1995 |

* cited by examiner

*Primary Examiner*—Hai Huynh
(74) *Attorney, Agent, or Firm*—Kathryn A. Marra

(57) ABSTRACT

A method and system to improve fuel economy of an engine on a vehicle is offered. An electronic throttle control device is commanded to a wide open throttle position during vehicle coast down, thus improving engine breathing and reducing pumping losses, and improving engine efficiency. This includes monitoring operator inputs to: an accelerator device, a braking device, and a cruise control device, and, monitoring throttle position control input from the electronic controller to the electronically controlled throttle mechanism. The electronically controlled throttle mechanism is commanded to a substantially wide-open throttle condition only when the monitored operator inputs to the accelerator device, the braking device, and the cruise control device are each at a null position. A further limitation on the wide-open throttle command includes monitoring other inputs from the electronic controller to the throttle mechanism.

11 Claims, 1 Drawing Sheet

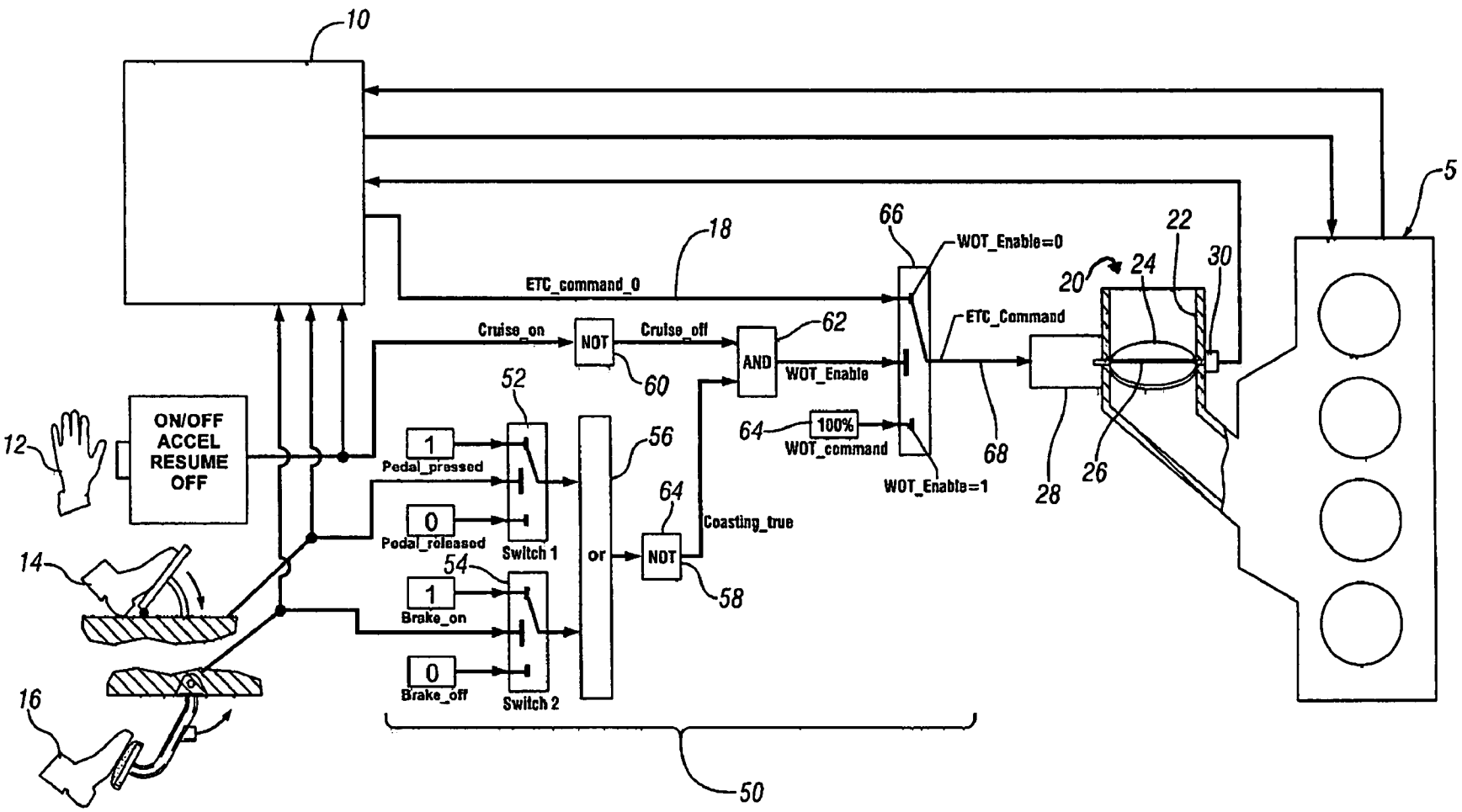
5
30
22
24
20
26
28
ETC_Command
68
WOT_Enable=0
WOT_Enable=1
66
62
AND
WOT_Enable
100%
WOT_command
64
Coasting_true
58
NOT
64
18
Cruise_off
60
NOT
56
or
ETC_command_0
Cruise_on
52
Switch 1
Switch 2
54
1
Pedal_pressed
0
Pedal_released
1
Brake_on
0
Brake_off
50
10
ON/OFF
ACCEL
RESUME
OFF
12
14
16

METHOD AND APPARATUS FOR CONTROLLING THROTTLE DURING VEHICLE COASTING

TECHNICAL FIELD

This invention pertains generally to internal combustion engine control systems, and more specifically to control of an internal combustion engine to reduce engine pumping losses.

BACKGROUND OF THE INVENTION

Technologists and designers for internal combustion engines implement various technologies and control strategies to improve engine characteristics such as fuel efficiency. Electronic throttle control is a technology that has been broadly implemented on internal combustion engines for passenger vehicles. Electronic throttle control offers opportunities for engine control, previously unavailable, that may be exploited to improve fuel economy. Improvements in engine characteristics through use of electronic throttle control strategies may benefit any engines employing throttles, including conventional spark-ignition engines, some compression-ignition engines, and engines that employ intermediate engine control strategies, such as homogeneous-charge compression-ignition engines.

One opportunity for improving fuel economy and managing engine operation comprises vehicle coasting, wherein input commands to the vehicle indicate that the operator has no need for braking or acceleration of the vehicle. Under such circumstances, there may be gains to fuel economy if the vehicle is able to sustain vehicle momentum during the coasting event. Prior systems to take advantage of vehicle momentum during coasting include transmission design and controls, such as optimization of torque converter designs and transmission control methods to decouple the engine from the driveline. Other systems have increased air flow through the engine by increasing engine idle control settings, to reduce engine pumping losses. Idle control systems are limited in their ability to improve engine breathing during coast down events, due to their limited authority to control air into the engine. What is needed is a method and system to improve engine performance during coast down events by improving engine breathing and reducing pumping losses, thus improving engine efficiency and fuel economy.

SUMMARY OF THE INVENTION

In accordance with the present invention, a method and system is offered which seeks to improve fuel economy of an internal combustion engine on a vehicle during engine coast down events by controlling the electronic throttle control system to a wide open throttle position, thus improving engine breathing and reducing pumping losses, and improving engine efficiency.

An aspect of the invention includes a method for controlling an internal combustion engine including an electronic controller and an electronically controlled throttle mechanism. This method comprises monitoring operator inputs to a plurality of devices; and, commanding the electronically controlled throttle mechanism to a substantially wide-open throttle condition only when all of the monitored operator inputs indicate an operator desire for vehicle coast.

Another aspect of the invention comprises commanding the electronically controlled throttle mechanism to a substantially wide-open throttle condition only when all of the monitored operator inputs indicate an operator desire for vehicle coast, wherein all of the monitored operator inputs indicate an operator desire for vehicle coast when each monitored input is within a respective predetermined range of operation.

Another aspect of the invention comprises disabling the command to control the electronically controlled throttle mechanism to a substantially wide-open throttle condition when at least one of the monitored inputs is outside the respective predetermined range of operation.

Another aspect of the invention comprises monitoring operator inputs to: an accelerator device, a braking device, and, a cruise control device.

Another aspect of the invention comprises disabling the command to control the electronically controlled throttle mechanism to a substantially wide-open throttle condition when the monitored operator input to the accelerator device indicates an operator accelerator input substantially greater than null.

Another aspect of the invention comprises disabling the command to control the electronically controlled throttle mechanism to a substantially wide-open throttle condition when the monitored operator input to the braking device indicates an operator braking input substantially greater than null.

Another aspect of the invention comprises disabling the command to control the electronically controlled throttle mechanism to a substantially wide-open throttle condition when the monitored operator input to the cruise control device indicates an intent to engage the cruise control device.

The method further comprises monitoring throttle position control input from the electronic controller to the electronically controlled throttle mechanism; and, disabling the command to control the electronically controlled throttle mechanism to a substantially wide-open throttle condition when the monitored throttle position control input from the electronic controller to the electronically controlled throttle mechanism indicates an intent to engage the cruise control device.

Another aspect of the invention comprises executing fuel cutoff to the engine during at least a portion of a period of time when the electronically controlled throttle mechanism is commanded to the substantially wide-open throttle condition.

These and other aspects of the invention will become apparent to those skilled in the art upon reading and understanding the following detailed description of the embodiments.

BRIEF DESCRIPTION OF THE DRAWING

The invention may take physical form in certain parts and arrangement of parts, the preferred embodiment of which will be described in detail and illustrated in the accompanying drawings which form a part hereof, and wherein:

The FIGURE is a schematic diagram, in accordance with the present invention.

DETAILED DESCRIPTION OF AN EMBODIMENT

Referring now to the drawing, wherein the showings are for the purpose of illustrating an embodiment of the invention only and not for the purpose of limiting the same, the FIGURE shows a schematic of an internal combustion engine 5 and controller 10 which has been constructed in accordance with an embodiment of the present invention. The exemplary method and system is executed on a spark-ignition internal combustion engine 5 having multiple cylinders, which is conventionally constructed and known to a skilled practitioner. The internal combustion engine 5 includes an air intake system (not shown in detail) for metering intake of air for engine combustion. The air intake system includes an electronic throttle control ('ETC') device 20, comprising an air bore 22 with a throttle blade 24 mounted upon a rotating shaft 26. The rotating shaft 26 is operably connected to an electric motor 28, and connected to an angular position sensor 30. The signal output of the angular position sensor 30 is input to the engine controller 10. The electrical motor 28 is operably attached to an ETC controller, and the angular position sensor provided as input to the ETC controller. The ETC controller of the exemplary embodiment is shown up-integrated into the engine controller 10, with an output control line 18 for controlling operation of the ETC device 20 shown, referred to as ETC_command_0.

The exemplary system includes several operator inputs preferred for control and operation of the ETC device 20, and for operation of the engine 5. Operator inputs include inputs from an accelerator pedal 14, a brake pedal 16, and cruise control 12, and are shown as inputs to the engine controller 10 and as specific inputs to the logic diagram 50 in accordance with the invention. The accelerator pedal input 14 preferably comprises a measure of operator input to the accelerator pedal, and comprises some form of sensor which measures pedal position, known to a skilled practitioner. The brake pedal input 16 preferably comprises a measure of operator input to the brake pedal, and comprises some form of sensor which measures pedal position, known to a skilled practitioner. The cruise control input 12 preferably comprises a measure of whether the operator has commanded operation of cruise control, and therefore that cruise control is commanded on. Additionally, in a system equipped with some form of adaptive cruise control, there may be a controller-initiated input to the device 20. Each input device has a null position, indicating there is no operator input to the respective device. Each input device, including calibration and input to the controller 10, is known to a skilled practitioner and not detailed herein.

In overall operation, the controller 10 monitors inputs from the vehicle operator, and from the engine operating conditions and ambient conditions, and controls, among other systems, the ETC device 20. The ETC device 20 commands the electrical motor 28 to rotate the shaft 26 to a predetermined position, thus positioning the throttle blade 24 to control flow of engine air, using feedback from the angular position sensor 30 to verify the throttle shaft attains the commanded position.

The controller 10 is preferably an electronic control module comprising a central processing unit signally electrically connected to volatile and non-volatile memory devices via data buses. The controller 10 is operably attached to other sensing devices and output devices to monitor and control engine operation. The output devices preferably include subsystems necessary for proper control and operation of the engine 5. In addition to the ETC system, other output devices of the exemplary internal combustion engine 5 on a modern passenger vehicle include: a fuel injection system, a spark-ignition control system, an exhaust gas recirculation system, and an evaporative control system. The sensing devices providing operational input to the engine include devices operable to monitor engine operation, external and ambient conditions, and operator demands. The aforementioned sensing devices are typically signally attached to the controller 10. Sensing devices of interest in this embodiment include operator inputs determined with the accelerator pedal, vehicle brake pedal, and, cruise control. Engine control algorithms are typically executed during preset loop cycles such that each control algorithm is executed at least once each loop cycle. Loop cycles are typically executed each 3, 6, 15, 25 and 100 milliseconds of ongoing engine operation. Other algorithms are executed in response to some form of interrupt signal sent to the controller 10 from one of the external sensors. Use of the controller 10 to control the operation of the internal combustion engine 5 is well known to one skilled in the art.

Referring again to the FIGURE, the logic diagram 50, preferably executed as one or more algorithms in the ETC controller, comprises a series of decisions based upon operating states of the accelerator pedal, the brake pedal, and the cruise control. In monitoring the accelerator pedal input 14, it is determined whether the pedal is pressed or released. When there is a non-null operator input to the accelerator pedal 14, i.e. the accelerator pedal is pressed by the operator by even a minimal amount, a logic state "1" is commanded through logic device 52. When the accelerator pedal 14 is not pressed, indicating a null input, a logic state "0" is commanded through logic device 52. In monitoring the brake pedal input 16, it is determined whether the operator presses the brake pedal, or alternatively, if it is released. When the brake pedal input 16 indicates the brake pedal is engaged by the operator by even a minimal amount, a logic state "1" is commanded through logic device 54. When the brake pedal input 16 indicates the brake pedal is not engaged, indicating a null input, a logic state "0" is commanded through logic device 54. The outputs of logic devices 52 and 54 are input through a logic 'NOR' function 56, 58. The output of the logic 'NOR' function 56, 58 is a logic state "1" only when the inputs to the brake pedal 16 and the accelerator pedal 14 indicate that both are not engaged, possibly indicating a coasting event. The output of the cruise control 12 is run through a logic NOT function 60, such that when the operator engages the cruise control system, the output of the logic NOT function 60 is logic state "0", and when cruise control is off, the output of the logic NOT function 60 is logic state "1". The output of the logic NOT function 60 and the logic 'NOR' function 56, 58 are passed through a logic AND device 62, the output of which is input to logic device 66. This three input logic device, as just described, provides a logic output of logic state "1" only when the cruise control is off, the brake pedal is disengaged, and the accelerator pedal is not pressed. In all other conditions, the output of the logic device 66 is logic state "0". Logic device 66 has inputs consisting of ETC_Command_0 18, from the controller 10, and a wide-open throttle command 64, and is controlled by output from the logic AND device 62. When output from the logic AND device 62 is a logic output of logic state "1", indicating the cruise control is off, the brake pedal is not pressed or engaged, and the accelerator pedal is not pressed, control signal 68 to operate the motor 28 of the ETC device 20 is commanded to be the wide-open throttle command 64. In any other condition, the control signal 68 to operate the motor 28 of the ETC device 20 is commanded to be the ETC_Command_0 18.

Although not shown in detail, the engine controller 10 is operable to execute a fuel cutoff to the engine during some or all of the period of time when the ETC device 20 is commanded to the wide-open throttle command 64. A skilled practitioner is able to determine when and how to execute a fuel cutoff, based upon such concerns as continuing engine operation and emissions control.

Although not shown in detail, the engine controller 10 is operable to disable the wide-open throttle command 64 for other reasons, such as to control accessory drives including, for example, air-conditioning compressors and battery charging devices. The engine controller 10 may disable the wide-open throttle command 64 to ensure the engine system complies with exhaust and evaporative emissions standards during this time. The engine controller 10 may disable the wide-open throttle command 64 to ensure components of the engine system are not unduly stressed during this time. Although not shown in detail, the engine controller may further control other driveline components, including, for example, a transmission, or a fuel injection system, to further take advantage of the operating condition.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. Method for controlling an internal combustion engine including an electronic controller and an electronically controlled throttle mechanism, comprising:

a) monitoring operator inputs to a plurality of devices; and, b) commanding the electronically controlled throttle mechanism to a substantially wide-open throttle condition only when all of the monitored operator inputs indicate an operator desire for vehicle coast.

2. The method of claim 1, wherein all of the monitored operator inputs indicate an operator desire for vehicle coast comprises: each monitored input within a respective predetermined range of operation.

3. The method of claim 2, further comprising: disabling the command to control the electronically controlled throttle mechanism to a substantially wide-open throttle condition when at least one of the monitored inputs is outside the respective predetermined range of operation.

4. The method of claim 3, wherein monitoring operator inputs to a plurality of devices comprises: monitoring operator inputs to: an accelerator device, a braking device, and, a cruise control device.

5. The method of claim 4, further comprising: disabling the command to control the electronically controlled throttle mechanism to a substantially wide-open throttle condition when the monitored operator input to the accelerator device indicates an operator accelerator input substantially greater than null.

6. The method of claim 4, further comprising: disabling the command to control the electronically controlled throttle mechanism to a substantially wide-open throttle condition when the monitored operator input to the braking device indicates an operator braking input substantially greater than null.

7. The method of claim 4, further comprising: disabling the command to control the electronically controlled throttle mechanism to a substantially wide-open throttle condition when the monitored operator input to the cruise control device indicates an intent to engage the cruise control device.

8. The method of claim 7, further comprising:

a) monitoring throttle position control input from the electronic controller to the electronically controlled throttle mechanism; and, b) disabling the command to control the electronically controlled throttle mechanism to a substantially wide-open throttle condition when the monitored throttle position control input from the electronic controller to the electronically controlled throttle mechanism indicates an intent to engage the cruise control device.

9. The method of claim 4, further comprising: executing fuel cutoff to the engine during at least a portion of a period of time when the electronically controlled throttle mechanism is commanded to the substantially wide-open throttle condition.

10. Article of manufacture, comprising:

a storage medium having a computer program encoded therein for effecting a method to control an electronically controlled throttle mechanism for an internal combustion engine, the computer program comprising:

a) code for monitoring operator inputs to: an accelerator device, a braking device, and a cruise control device;

c) code for commanding the electronically controlled throttle mechanism to a substantially wide-open throttle condition only when the monitored operator inputs to the accelerator device, the braking device, and the cruise control device indicate an operator desire for vehicle coast.

11. Method for controlling an internal combustion engine including an electronic controller and an electronically controlled throttle mechanism, comprising:

monitoring operator inputs to: an accelerator device, a braking device, and, a cruise control device;

monitoring throttle position control input from the electronic controller to the electronically controlled throttle mechanism;

commanding the electronically controlled throttle mechanism to a substantially wide-open throttle condition only when the monitored operator inputs to the accelerator device, the braking device, and the cruise control device are each substantially null; and, disabling the command to control the electronically controlled throttle mechanism to a substantially wide-open throttle condition when the monitored throttle position control input from the electronic controller to the electronically controlled throttle mechanism indicates an intent to engage the cruise control device.

* * * * *